US005114292A

United States Patent [19]

Geiser

[11] Patent Number: 5,114,292

[45] Date of Patent: May 19, 1992

[54] PERFECT BINDER

[75] Inventor: Peter Geiser, Matzingen, Switzerland

[73] Assignee: Grapha-Holding AG, Hergiswil, Switzerland

[21] Appl. No.: 685,527

[22] Filed: Apr. 15, 1991

[30] Foreign Application Priority Data

Apr. 23, 1990 [CH] Switzerland ..... 1364/90

[51] Int. Cl.[5] ..... B42C 13/00

[52] U.S. Cl. ..... 412/11; 412/57; 118/256

[58] Field of Search ..... 412/8, 11, 37, 900; 118/256, 679

[56] References Cited

U.S. PATENT DOCUMENTS 4,456,379 6/1984 Shumann et al. ..... 412/11 X
4,697,971 10/1987 Muller ..... 412/33
4,775,137 10/1988 Glanzmann ..... 270/54
4,925,354 5/1990 Cote ..... 412/11 X

FOREIGN PATENT DOCUMENTS 1447705 12/1988 U.S.S.R. .

*Primary Examiner*—Timothy V. Eley
*Assistant Examiner*—Fridie, Jr. Willmon
*Attorney, Agent, or Firm*—Peter K. Kontler

[57] ABSTRACT

A perfect binder wherein the grippers of a transporting unit advance discrete stacks of paper sheets along a horizontal path past a series of successive treating stations from a stack receiving location of the grippers are located in a common plane, and those portions of the stacks which require treatment extend downward beyond the respective undersides. A second unit of the perfect binder includes a set of treating devices (which can include aligning panels, milling tools, grinding tools, adhesive applicators and cover applicators) which are mounted on a platform beneath the path for the stacks and are individually adjustable toward or away from the common plane. In addition, the perfect binder is provided with an apparatus which can move the transporting unit and/or the second unit toward or away from the other unit in order to simultaneously alter the spacing of all treating devices relative to the common plane.

11 Claims, 2 Drawing Sheets

PERFECT BINDER

BACKGROUND OF THE INVENTION

The invention relates to improvements in bookbinding machines in general, and more particularly to improvements in bookbinding machines of the type known as perfect binders wherein the backs and certain other portions of stacks of paper sheets are coated with adhesive prior to attachment of covers. Such machines can be utilized for mass production of books (e.g., soft cover books), brochures, pamphlets and similar printed products.

It is already known to provide a perfect binder with a transporting unit having a set of grippers or tongs which can be closed to engage discrete stacks of sheets at a receiving location and to thereupon advance the engaged stacks past several successive treating stations (where various tools treat selected portions of the stacks, particularly those portions which extend downwardly beyond the undersides of the respective grippers) and on to a removing or withdrawing location. The undersides of all grippers in the path between the receiving and removing locations can be disposed in a common plane. It is further known to provide such perfect binders with mechanisms which can individually adjust the distance of each treating tool from the common plane of the undersides of the grippers. This is desirable and advantageous because the treatment at one or more stations can be intensified, eliminated or otherwise altered, depending on the nature of the conveyed material and upon the desired quality of books, brochures or pamphlets (hereinafter referred to as books for short).

An important characteristic of a finished stack which is ready to be connected with a cover is the extent to which the back of the book (i.e., the lowermost portion of the stack between the jaws of a gripper) extends downwardly beyond the underside of the respective gripper. The extent to which the lowermost portion of a stack which is ready to be adhesively connected with a cover projects beyond the underside of the corresponding gripper can be altered by adjusting the level or levels of grinding, milling and/or other material removing tools which are installed beneath the path of the grippers between the receiving and removing locations. In many instances, the height of the lower portion of a stack beneath its gripper will depend on the nature of the covers which are to be applied to the treated and adhesive-coated stacks. Thus, the extent to which a stack projects downwardly beyond the underside of the respective gripper will determine the width of the layers of adhesive which can be applied to portions of the two major sides of a treated stack if a cover is to adhere to the back as well as to adjacent portions of major sides of the stack of paper sheets in a finished book.

The person in charge of setting up a perfect binder seeks to shorten that portion of a stack which extends downwardly beyond the corresponding gripper because the treatment of stacks is more difficult if the trimming, milling, grinding and/or other tools are required to remove a relatively large quantity of paper at the underside of the path of movement of the grippers. In fact, once the height of the downwardly projecting portion of a stack reaches a certain value, the tools at the underside of the path for the stacks and for their grippers are incapable of removing all of the material or can remove the material at the expense of the appearance (quality) of the finished printed products.

In order to facilitate the task of a person in charge of setting up a perfect binder, the machine is equipped with various gauges or other indicating instruments which render it possible to ascertain the positions of various tools relative to the common plane of the undersides of the grippers for discrete stacks. Individual adjustment of each treating tool relative to the aforementioned plane is a time-consuming operation and affects the output of the perfect binder if the machine is to be set up in a different way at frequent intervals.

A drawback of presently known perfect binders is that the instruments which indicate the positions of various treating tools relative to the common plane of the undersides of grippers for discrete stacks of printed sheets do not furnish direct indications of several parameters which are important in order to properly set up the binder for a particular bookbinding operation. More particularly, the presently utilized instruments do not indicate the actual positions of the respective treating tools relative to the downwardly projecting portions of stacks of paper sheets in the grippers. Moreover, such instruments do not directly indicate the levels of the respective treating tools with reference to the levels of other treating tools. For example, if the height or length of the downwardly projecting (exposed) lower portion of a stack exceeds the standard height by 3 mm, the indicator which is associated with a customary roller-shaped adhesive applicator indicates 4 mm even though the thickness of the adhesive layer which is applied to the exposed lower portion of a stack is only 1 mm. The situation is analogous as concerns the information which is furnished by the indicators cooperating with other treating tools beneath the path of movement of the grippers and stacks from the receiving location to the removing location of a standard perfect binder. Therefore, the person in charge must waste considerable time to calculate the relative positions of the treating tools and the positions of such tools relative to the common plane of the undersides of grippers prior to starting with, or in the course of, a change of setup. A single relatively minor error can necessitate the ejection of a large number of unacceptable printed products. As a rule, final adjustments are made during a test run which involves the production of a large number of unacceptable books because the person in charge of altering the setup must examine the quality of finished products prior to repeatedly adjusting one or more treating tools in order to eliminate defects or to improve the quality of the books so that it meets the prescribed norm.

OBJECTS OF THE INVENTION

An object of the invention is to provide a novel and improved perfect binder wherein a change of setup, at least for the making of certain types of books, can be completed in a simple and time-saving manner.

Another object of the invention is to provide a perfect binder wherein a change of setup need not always and invariably necessitate individual adjustment of each and every treating tool.

A further object of the invention is to provide the perfect binder with novel and improved means for changing the positions of the stack transporting and stack treating units relative to each other.

An additional object of the invention is to provide a perfect binder which can turn out larger quantities of books or other printed products than heretofore known perfect binders even though its output per unit of time need not exceed the output of conventional machines.

Still another object of the invention is to provide a perfect binder wherein a change of setup or a series of changes of setup can be completed within short intervals of time and without the making of any discards or in a manner which involves the making of a negligible number of unacceptable printed products.

A further object of the invention is to provide the perfect binder with novel and improved means for ensuring that the mutual positions of various tools need not be changed at all if such changes are not needed even though the person in charge decides to change the initial height or length of exposed portions of freshly admitted stacks of printed paper sheets or the like.

Another object of the invention is to provide a novel and improved method of rapidly and predictable changing the setup of a perfect binder.

An additional object of the invention is to provide a perfect binder which exhibits one or more of the aforediscussed features and whose operation can be automated to any desired extent.

SUMMARY OF THE INVENTION

The perfect binder of the present invention can be used to bond covers to stacks of sheets by means of an adhesive. The improved perfect binder comprises a first unit having means for transporting a series of stacks along a predetermined path in a predetermined direction past a plurality of successive treating stations which are located between a stack receiving location and a book or brochure withdrawing location. The transporting means comprises discrete grippers for the stacks of the series, and such grippers have reference surfaces disposed in a common plane. The perfect binder further comprises a second unit including a plurality of stack treating devices, at least one at each treating station and adjacent to but still spaced apart from the common plane, and means for moving one of the units relative to the other unit to thereby change the spacing of the treating devices from the common plane.

The perfect binder preferably further comprises means for individually adjusting the spacing of at least one of the treating devices from the common plane. It is presently preferred to employ means for jointly moving the treating devices relative to the transporting means. Furthermore, the adjusting means preferably comprises means for individually adjusting two or all of the treating devices relative to the transporting means and relative to the moving means.

The moving means can comprise a carrier (e.g., in the form of a platform) for the one unit (preferably for the treating devices), a support (such as a stationary frame or housing) for the carrier, and means (e.g., one or more rack and pinion drives) for displacing the carrier relative to the support. If the support mounts the treating devices, it is adjacent the common plane and the displacing means of such moving means comprises means (such as the aforementioned rack and pinion drive or drives) for moving the carrier and the treating devices toward and away from the common plane. The adjusting means of such perfect binder comprises means for individually adjusting at least one of the treating devices relative to the carrier in directions toward and away from the common plane. The carrier can be provided with a reference surface which confronts the surfaces of the grippers and is located in a second plane preferably extending in parallelism with the common plane. The treating devices extend or can extend beyond the second plane toward the common plane, and the second plane remains or can remain at least substantially parallel to the common plane during and subsequent to displacement of the carrier relative to the support.

The perfect binder can further comprise means for indicating the positions of the one unit relative to the other unit and/or means for indicating the positions of the at least one (individually adjustable) treating device relative to the common plane. The arrangement may be such that the perfect binder further comprises computerized control means for the adjusting means and/or for the moving means, and the indicating means for the positions of the one unit and/or the indicating means for the position of the at least one treating device can form part of the control means.

The novel features which are considered as characteristic of the invention are set forth in particular in the appended claims. The improved perfect binder itself, however, both as to its construction and the mode of operating the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
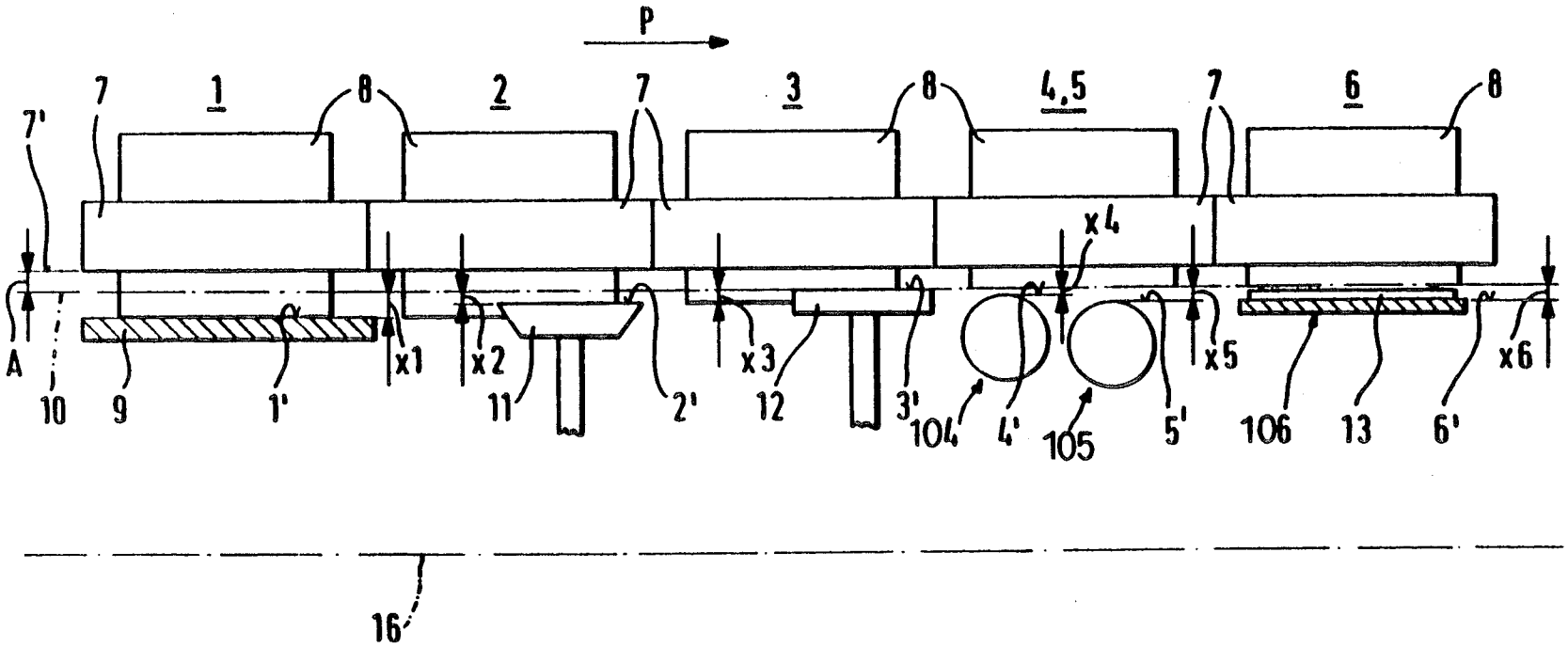
FIG. 1 is a fragmentary schematic partly elevational and partly vertical sectional view of a perfect binder which embodies one form of the invention and comprises five discrete treating stations between the stack admitting or receiving location and the book discharging or removing location.

Referring to FIG. 1, there is shown a perfect binder having a first unit which includes means for transporting a series of discrete stacks 8 of paper sheets along a horizontal or substantially horizontal path in the direction of arrow P. The transporting means includes a set of grippers 7 which can be of the type described and shown in commonly owned U.S. Pat. No. 4,697,971 to Hans Müller and serve to transport stacks 8 from a receiving location (see FIG. 1 of the patent) to a releasing location where the finished books leave the machine. The grippers 7 advance the stacks 8 past a series of treating devices 9, 11, 12, 104–105, 106 which are respectively located at treating stations 1, 2, 3, 4–5 and 6 at a level beneath the common horizontal plane 7' of the undersides or lower surfaces of the grippers. The arrangement is preferably such that the grippers 7 are advanced at a constant speed along an endless path leading from the receiving location at or ahead of the first treating station 1, to the last treating station 6, to the removing location and back to the receiving location. The stacks 8 are accumulated in a suitable gathering machine (e.g., a machine of the type described and shown in commonly owned U.S. Pat. No. 4,775,137 to Alfred Glanzmann) and are delivered to the first treating station 1 in such a way that their sheets or groups of sheets rest on their backs. Each stack 8 can be assembled of single or double square folded sheets in a manner not forming part of the present invention.

Each gripper 7 comprises two jaws which are moved apart not later than when they reach the treating station 1 so that they permit the deposition of a freshly delivered stack 8 onto the first treating device 9 in the form of a table having an upper side or surface 1' located at a selected distance from the common plane 7' of the undersides of the grippers 7. The individual sheets or groups of sheets of a stack 8 which arrives at the station 1 are caused to contact the upper side 1' of the table 9 so that a predetermined portion of the stack 8 at the station 1 extends downwardly beyond the plane 7'. The height of the exposed or accessible lower portion of the stack 8 at the station 1 equals A+x1 wherein A is the desired final height of such exposed portion and x1 is the difference between A and the spacing or distance of the plane 7' from the upper side or surface 1' of the table 9. The distance A+x1 is selected with a view to ensure the removal of a certain amount of paper from the exposed portion of the stack 8 at the stations 2 and 3, and to permit the application of two layers or films of suitable adhesive at the station 4–5, before the thus treated stack 8 reaches the last treating station 6 to be provided with a cover 13. The treatments at the stations 2 and 3 involve removal of a stack portion having a height x1, and such removal takes place in two stages, namely at the stations 2 and 3.

The reference character 10 denotes in FIG. 1 a plane which is parallel to the common plane 7' of the undersides of grippers 7 and is the plane of the underside of the exposed lower portion of a stack 8 at the treating station 6. Thus, the distance or spacing of the planes 7' and 10 from each other equals A.

The jaws of successive grippers 7 are closed at or immediately downstream of the first treating station 1, namely as soon as the individual sheets or groups of sheets of a stack 8 come into contact with the upper side 1' of the table 9. Thus, the sheets of a stack 8 which is about to leave, or is in the process of leaving, the station 1 are clamped by the closed jaws of the respective gripper 7 and remain in clamped condition on their way toward and past the next-following stations 2, 3, 4–5 and 6 and on to the delivery location where the freshly formed books are transferred onto another transporting unit or are evacuated from the improved perfect binder in any other way.

The stack 8 which is in the process of advancing past the second station 2 is treated by the second treating device 11 in the form of a rotary milling tool the upper side 2' of which is spaced apart from the common plane 7' by a distance A+x2. The difference between x1 and x2 (i.e., between the levels of the upper sides 1' and 2') determines the quantity of material which is removed by the milling tool 11.

The stack 8 which has advanced beyond the station 2 is thereupon treated by the third treating device 12 in the form of a rotary grinding wheel at the station 3. The grinding wheel 12 can be said to constitute a trimming or precision finishing device which removes material extending downwardly beyond the plane 10. The height of the thus removed portion of the stack 8 is shown at x3 whereby x2+x3 equals x1. Thus, the distance x3 denotes the difference between the levels of the upper side 2' of the milling device 12 and the upper side 3' of the grinding wheel 12. The distance between the level of the upper side 3' of the grinding wheel 12 and the plane 10 equals zero, i.e., the distance of the underside of a stack 8 which has advanced beyond the treating station 3 from the plane 7' equals A.

The treating station 4, 5 is an adhesive applying station with two treating devices 104, 105 each of which constitutes a wheel-shaped or roller-shaped glue applicator. The first applicator 104 applies a film having a thickness x4, and the second applicator 105 applies a film having a thickness X5–x4 wherein x5 is the combined thickness of the two adhesive films. The level of the topmost portion of the peripheral surface of the first applicator 104 is shown at 4', and the level of the topmost portion of the second applicator 105 is shown at 5'. The distance of the level 4' from the plane 7' equals x4, and the distance of the level 5' from the plane 7' equals x5.

The treating station 6 accommodates a treating device 106 in the form of a plate or panel which serves to press a freshly delivered cover 13 against the underside of the lower or second adhesive film. The distance x6 is the spacing of the upper side 6' of the plate 106 from the plane 7'. If the application of adhesive involves the application of one or more films to the undersides of successive stacks 8 which arrive at the station 4–5, as well as the application of adhesive films to the exposed lower portions of major sides or surfaces of successive stacks 8, the covers 13 are pressed against the lower portions of the major sides of stacks 8 at the station 6 or at a station which follows the station 6.

The jaws of successive grippers 7 are moved apart upon arrival at the removing location which follows the fifth treating station 6, and the finished books are caused or permitted to descend onto or to otherwise reach a takeoff conveyor or the like, not shown.

Figure 2:
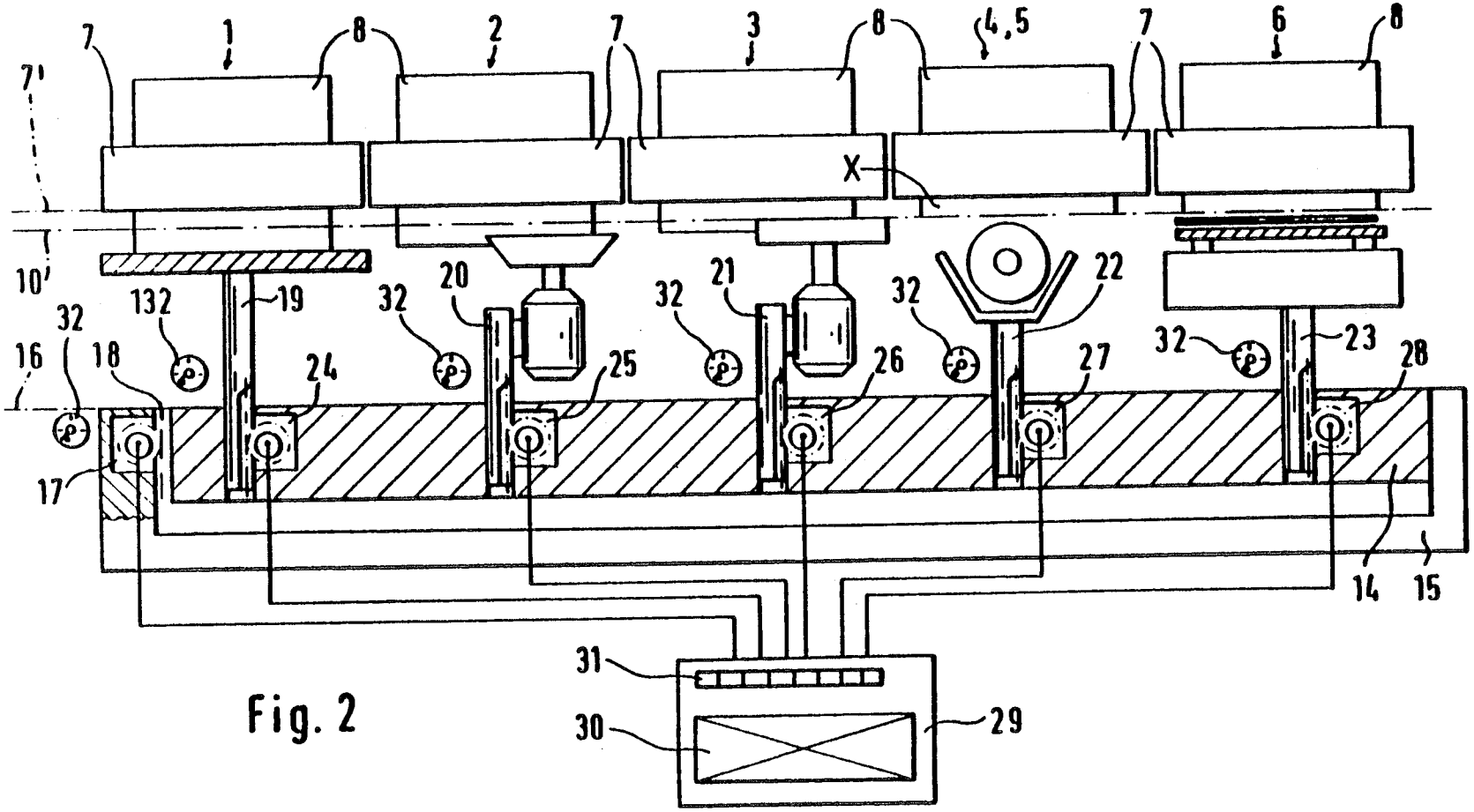
FIG. 2 is a similar fragmentary partly elevational and partly vertical sectional view but showing certain additional details of the improved perfect binder.

FIG. 2 shows certain details of the perfect binder of FIG. 1 plus certain additional details. In accordance with a feature of the invention, the perfect binder further comprises means for simultaneously or jointly moving the treating devices 9, 11, 12, 104–105, 106 at the stations 1, 2, 3, 4–5 and 6 and the transporting unit including the grippers 7 relative to each other in order to vary the spacing of the upper sides 1' to 6' from the common plane 7' of the undersides of the grippers 7. In the illustrated embodiment, the moving means is designed to raise or lower the treating tools 9, 11, 12, 104, 105 and 106 relative to the grippers 7. Such moving means comprises a carrier 14 in the form of a horizontal platform having an upper side disposed in a horizontal plane 16. This plane is parallel to the plane 7' when the moving means is idle as well as while the carrier 14 is in the process of moving the treating devices 9, 11, 12, 104, 105 and 106 up or down, i.e., toward or away from the transporting means including the grippers 7. The carrier 14 is movable up and down and is guided for such movement in a stationary support 15 which can constitute or form part of the housing or frame of the perfect binder. The means for displacing the carrier 14 and the treating devices thereon relative to the support 15 includes at least one stepping motor 17 which is mounted in or on the support 15 and one or more rack and pinion drives 18 (one shown in FIG. 2). The illustrated drive 18 comprises an upright rack which is affixed to the carrier 14, and a rotary pinion which is driven by the output element of the stepping motor 17 and meshes with the rack. This drive can alter the distance of the plane 16 from the plane 7'.

The working ends of portions of the treating tools 9, 11, 12, 104, 105 and 106 extend upwardly beyond the plane 16, and the distances of the upper sides 1' to 6' from the plane 7' can be individually varied by discrete adjusting means including upright toothed racks 19 to 23 which are vertically movably guided in the carrier 14 and can be moved by discrete stepping motors 24 to 28, respectively. The rack 19 carries the table 9, the rack 20 carries the milling device 12 and its motor, the rack 21 carries the grinding wheel 13 and its motor, the rack 22 carries the roller-shaped adhesive applicators (of which only one is shown in FIG. 2), and the rack 23 carries the plate 106. The stepping motors 24, 25, 26, 27, 28 for the vertically movable racks 19, 20, 21, 22 and 23, respectively, are installed in or on the carrier 14. Each of the stepping motors 24–28 can rotate a discrete pinion which mates with the respective toothed rack (19–23). The just described adjusting means enables a person in charge of changing the setup of the perfect binder to individually select the spacings of the upper sides 1' to 6' from the common plane 7' of the undersides of the grippers 7.

If a change of setup merely involves selecting a different distance A (i.e., if the relationship of the levels of the upper sides 1' to 6' with reference to each other can remain unchanged), the person in charge merely starts the stepping motor 17 to raise or to lower the carrier 14 and all of the treating devices thereon without altering the levels of the upper sides 1' to 6' relative to each other and/or relative to the plane 16. All the person in charge must ensure is that the upper side 3' of the grinding wheel 12 (i.e., of the treating device which determines the ultimate height of the downwardly extending exposed portion of a stack 8 advancing beyond the station 3) is spaced apart from the plane 7' by a distance which matches the desired new value of A. The distances of the upper sides 1', 2', 4', 5', 6' from the plane 16 are changed to the same extent as the distance of the upper side 3' from the plane 7' because the person in charge merely starts the stepping motor 17 but need not actuate the stepping motor 24, 25, 26, 27 and/or 28.

As a rule, the distance A will be selected with a view to determine the width of adhesive films which are to be applied to the major sides or surfaces of the stacks 8 (the lower portion of one of these major sides or surfaces is shown in FIG. 2, as at X). On the other hand, the distances or spacings of the upper sides 1', 2', 4', 5' and 6' from the plane 7' will be determined or selected in dependency upon the desired quality of the books which leave the station 6. Such selection of the spacings of the upper sides 1', 2', 4', 5' and/or 6' from the plane 7' or 10 will be made in dependency upon the thickness of the books, on the thickness of paper sheets, on the number of sheets in a square folded sheet, on the quality of paper, on the thickness of the covers 13 and/or other parameters. The person in charge will start eh motor 24, 25, 26, 27 and/or 28 if a change of setup necessitates joint adjustment of all treating devices as well as individual adjustment of one or more discrete treating devices.

The improved perfect binder is preferably further equipped with means for indicating the selected distance A as well as the selected spacings of the levels 1' to 6' from the plane 7' or 10. To this end, the machine is equipped with a computerized control unit 29 which comprises a keyboard 30 for actuation of the stepping motors 17 and 24 to 28 as well as for actuation of certain other components of the perfect binder, and a display 31 which constitutes a means for automatically indicating the selected distance A and/or the selected spacings of the upper sides 1' to 6' from the plane 7' and/or 10. The control unit 29 can be further equipped with means (not specifically shown) for recording the selected setup so that the setup can be repeated as often as desired. The information can be recorded by a printer and/or in a suitable memory (e.g., a digital memory) of the control unit 29. The recorded information can be reused as often as necessary to rapidly reestablish the optimum circumstances for the making of particular types of books. Depending on the sophistication of the selected control unit 29, the information which is displayed at 31 can be recorded by hand for future renewed use of the same setup.

In addition to or in lieu of resorting to a display 31 which is to indicate the selected distance A as well as the selected spacings of the upper sides 1' to 6' from the plane 7' and/or 10, the improved perfect binder can be equipped with a discrete indicator 32 (e.g., a gauge or the like) for each individual treating station beneath the plane 7'. Still further, the carrier 14 can be equipped with a graduated scale (not shown) for each of the racks 19 to 23, and each of these racks can carry a pointer which is movable along the adjacent graduated scale. The just discussed scales and pointers then indicate the distances of the upper sides 1' to 6' from the plane 16 of the upper side of the carrier 14. The indicator 132 which is shown in the left-hand portion of FIG. 2 is or can be designed to indicate the distance of the plane 16 from the plane 7'.

An important advantage of the improved perfect binder is that a change of setup can be completed within a small fraction of the time which is required to complete a change of setup in a conventional perfect binder without the improved moving means which, in the illustrated embodiment, includes the carrier 14, the support 15 and the displacing means 17, 18. Such rapid change of setup can be carried out if the levels of the upper sides 1' to 6' relative to each other need not be altered while the person in charge is in the process of changing the distance A.

Another important advantage of the improved perfect binder is that the aforediscussed moving means can be installed in certain existing bookbinding machines wherein the levels of various treating tools relative to the means for transporting the stacks can be selected in a conventional way.

A further important advantage of the improved perfect binder is that a particular setup can be memorized and rapidly reestablished in a fully automatic way to thus further reduce the length of intervals which are required to complete a change of setup.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A perfect binder wherein stacks of sheets are bonded to covers by means of an adhesive, comprising a first unit having means for transporting a series of stacks along a predetermined path in a predetermined direction past a plurality of successive treating stations from a receiving to a withdrawing location, said transporting means including discrete grippers for the stacks of said series and said grippers having surfaces disposed in a common plane; a second unit including a plurality of treating devices, at least one at each of said stations and each adjacent but spaced apart from said plane; and means for moving one of said units relative to the other of said units to thereby change the spacing of said treating devices from said plane.

2. The perfect binder of claim 1, further comprising means for individually adjusting the spacing of at least one of said devices from said plane.

3. The perfect binder of claim 2, wherein said moving means comprises means for jointly moving said devices relative to said transporting means and said adjusting means comprises means for individually adjusting each of said devices relative to said transporting mean and relative to said moving means.

4. The perfect binder of claim 1, wherein said moving means includes a carrier for said one unit, a support for said carrier, and a drive mounted on said support and having means for displacing said carrier relative to said support

5. The perfect binder of claim 4, wherein said support is adjacent said plane and said carrier mounts said devices, said displacing means including means for moving said carrier and said devices toward and away from said plane.

6. The perfect binder of claim 5, further comprising means for individually adjusting at least one of said devices relative to said carrier in directions toward and away from said plane.

7. The perfect binder of claim 6, wherein said carrier has a surface which confronts the surfaces of said grippers and is located in a second plane parallel to said common plane.

8. The perfect binder of claim 7, wherein said devices extend beyond said second plane and said second plane remains at least substantially parallel to said common plane during and subsequent to displacement of said carrier relative to said support.

9. The perfect binder of claim 1, further comprising means for indicating the positions of said one unit relative to said other unit.

10. The perfect binder of claim 9, further comprising computerized control means for said moving means, said control means including said indicating means

11. The perfect binder of claim 1, further comprising means for individually adjusting the spacing of at least one of said devices relative to said plane and means for indicating the positions of said at least one device relative to said plane.

* * * * *